US005390922A

United States Patent [19]

Cornish, III

[11] Patent Number: 5,390,922

[45] Date of Patent: Feb. 21, 1995

[54] GOLF CLUBS AND METHODS

[75] Inventor: Joseph J. Cornish, III, Marietta, Ga.

[73] Assignee: Bradley K. Stone, Roswell, Ga.

[21] Appl. No.: 210,140

[22] Filed: Mar. 17, 1994

Related U.S. Application Data

[63] Continuation-in-part of Ser. No. 32,376, Mar. 18, 1993.

[51] Int. Cl.[6] ..... A63B 53/04; A63B 53/10

[52] U.S. Cl. ..... 273/81.6; 273/167 E; 273/DIG. 6; 273/168

[58] Field of Search ..... 273/167 R–77 A, 273/80 R, 81 B, 81.6, 81.5, 80 B, 80.6, 80.9, DIG. 6; D21/214, 221

[56] References Cited

U.S. PATENT DOCUMENTS

| | | | |
|---|---|---|---|
| D. 183,180 | 7/1958 | Phillips . | |
| D. 185,717 | 7/1959 | Newton . | |
| D. 231,624 | 5/1974 | Wilmoth . | |
| D. 268,357 | 3/1983 | Mader . | |
| D. 277,221 | 1/1985 | Kobayashi . | |
| D. 298,767 | 11/1988 | Szczepanski . | |
| D. 307,783 | 5/1990 | Iinuma . | |
| D. 316,583 | 4/1991 | Mahaffey . | |
| 1,317,146 | 9/1919 | Welles | 273/80 B |
| 1,418,038 | 5/1922 | Tousey | 273/80 R |
| 1,431,313 | 10/1922 | Lawton . | |
| 1,526,438 | 2/1925 | Scott . | |
| 1,587,758 | 6/1926 | Charavay | 273/167 E |
| 1,662,712 | 3/1928 | Mensing . | |
| 1,781,290 | 11/1930 | Margrave | 273/81.5 |
| 2,020,679 | 11/1935 | Fitzpatrick | 273/80 B |
| 2,023,885 | 12/1935 | Hinckley | 273/168 X |
| 2,083,189 | 6/1937 | Crooker | 273/167 E |
| 2,573,361 | 10/1951 | Rodgers . | |
| 2,822,175 | 4/1958 | Redmond | 273/80 B |
| 2,912,245 | 11/1959 | Gardner | 273/DIG. 6 |
| 3,416,798 | 12/1968 | Pennington | 273/168 |
| 3,458,611 | 7/1969 | Roberts . | |
| 3,469,338 | 9/1969 | Hills . | |
| 3,625,518 | 12/1971 | Solheim . | |
| 3,764,137 | 10/1973 | Petro | 273/80 B |
| 4,135,035 | 1/1979 | Branen | 273/80 R |
| 4,498,673 | 2/1985 | Swanson . | |
| 4,555,113 | 11/1985 | Shimazaki | 273/80 B |
| 4,648,598 | 3/1987 | Kim . | |
| 4,757,997 | 7/1988 | Roy . | |
| 5,042,805 | 8/1991 | Nakai . | |
| 5,092,599 | 3/1992 | Okumoto . | |
| 5,190,289 | 3/1993 | Nagai | 273/167 E |

FOREIGN PATENT DOCUMENTS

| | | | |
|---|---|---|---|
| 2581319 | 11/1986 | France | 273/80 B |
| 16471 | 7/1910 | United Kingdom | 273/80 R |
| 373930 | 6/1932 | United Kingdom | 273/80 R |
| 462155 | 3/1937 | United Kingdom | 273/81.6 |

OTHER PUBLICATIONS

"Plastics World" Magazine, Sep. 1984 Issue, pp. 39–41.

*Primary Examiner*—Sebastiano Passaniti
*Attorney, Agent, or Firm*—Hopkins & Thomas

[57] ABSTRACT

Novel golf clubs (10, 50) and associated methodology optimally minimize air resistance during swinging motion of the golf club (10). A first golf club (10) comprises a head (12) a handle (18) and a shaft (22) connecting the head (12) with the handle (18). A rib (24) protrudes outwardly from the shaft (22) and runs longitudinally along the shaft (22) in a spiral configuration. The spiral configuration has a pitch which decreases from the head (12) to the handle (18). The spiraling configuration of the rib (24) minimizes vortices and drag generated when the golf club (10) is in motion to thereby decrease air resistance to the golf club (10). Furthermore, the golf club (10) is provided with a novel head (12) having a body with a face (14) angled inwardly, a rear end (38) angled inwardly, right and left sides decreasing in curvature from the rear end (38) to the face (14), a substantially flat bottom (46), and a top (48) which is circular as viewed from the face (14) and is parabolic as viewed from the right and left sides (42, 44). A second golf club (50) has a series of X-like elements (58*a*) running linearly and longitudinally along the face of the shaft (22) facing club motion for breaking up air vortices during club motion. The series of X-like elements (58*a*) are preferably formed by first and second ribs (54*a*, 54*b*), which spiral in opposite senses about the shaft (22).

18 Claims, 3 Drawing Sheets

GOLF CLUBS AND METHODS

This document is a continuation-in-part of application entitled "GOLF CLUB AND METHOD" with Ser. No. 08/032,376, filed on Mar. 18, 1993 by the same inventor herein.

FIELD OF THE INVENTION

The present invention generally relates to the sport of golf and, more particularly, to novel golf clubs and methods for minimizing air resistance during golf club swinging motion.

BACKGROUND OF THE INVENTION

A golf club includes a head for striking a golf ball, a handle including a grip for swinging the golf club, and a shaft connecting the head to the handle. A golf club encounters air resistance when it is swung for hitting a ball because air votices, or votex cores, are created at the trailing surface of the golf club shaft. This air resistance results in a drop in head speed, an irregular vibration in the shaft of the golf club, and very discernable noise. Moreover, the drop in head speed in turn reduces the flying distance of the ball, and the irregular vibration of the shaft affects the direction of the ball.

Attempts have been made in the past to construct a golf club which minimizes air resistance. U.S. Patent No. 4,648,598 to Kim describes a golf club with an air permeable shaft. The golf club comprises a air permeable skeletal-like shaft formed from a plurality of spaced rods which are concentrically arranged about a longitudinal axis. A spiral wrapping is disposed about the skeletal-like shaft of the golf club for providing structural reinforcement. The rods allegedly reduce wind drag or resistance during the golf swing. Although perhaps not devoid of all merit, the foregoing construction suffers from extreme complexity, questionable durability, expensive and burdensome construction, aesthetically displeasing appearance, and only nominal reduction in wind resistance during the golf club swing.

SUMMARY OF THE INVENTION

Accordingly, an object of the present invention is to overcome the deficiencies and problems associated with the prior art as recited above.

Another object of the present invention is to provide a golf club and method which optimally minimize wind resistance during golf club swinging motion.

Another object of the present invention is to provide a golf club and method which optimally minimizes and breaks up vortices, or vortex cores, produced at the trailing surface of a golf club shaft during swinging motion.

Another object of the present invention is to provide a golf club and method which are simple and inexpensive to implement.

Another object of the present invention is to provide a golf club which is aesthetically pleasing.

Another object of the present invention is to provide a golf club which is simple in design, durable in structure, and reliable while in use.

Another object of the present invention is to provide a golf club which minimizes air resistance while conforming to the stringent requirements of the U.S. Golf Association (USGA).

Briefly described, the present invention involves improvements for any golf club having a head for striking a golf ball and a shaft connected to the head at a first end and having a handle at a second end. The improvements substantially reduce air resistance to the golf club while the golf club is in swinging motion.

A first embodiment of the present invention is a golf club having a rib protruding slightly outwardly from the surface of the shaft and running longitudinally along the shaft in a spiral configuration. Preferably, the rib is formed in a spiral configuration with a spiralling pitch which increases from the head to the handle of the golf club. The spiral configuration of the rib optimally minimizes air vortices and drag generated when the golf club is in motion to thereby decrease air resistance to the golf club.

A second embodiment of the present invention is a golf club having a plurality of X-like (or cross-like) rib elements disposed on the shaft. The X-like rib elements protrude outwardly from the shaft and are arranged linearly along a surface of the shaft which strikes air during a club swing. Moreover, the rib elements are preferably formed by two spiral ribs running longitudinally along the shaft, each of the ribs having a pitch which increases from the head to the handle.

In order to further minimize air resistance, the novel golf clubs of the first and second embodiments may be provided with a novel head which minimizes air resistance. The novel head comprises a body having a face angling inwardly, a rear end angling inwardly, right and left sides decreasing in curvature from the rear end to the face, a substantially flat bottom, and a top which is circular as viewed from the face and which is parabolic as viewed from the sides. Moreover, in the head, the width of the face as measured from the front is shorter than the length of the head as measured from one of the sides. The shape of the head results in improved aerodynamics and yet still conforms to USGA requirements.

Another feature of the present invention is that the golf club shafts and/or golf club heads may be provided with a rough or abrasive outer surface, for example, by affixing tiny material granules or particles thereto, in order to minimize air resistance by decreasing separation drag.

Other objects, features, and advantages of the present invention will become apparent to one of skill in the art upon examination of the following drawings and detailed description.

DETAILED DESCRIPTION OF THE PREFERRED EMBODIMENT

Figure 1:
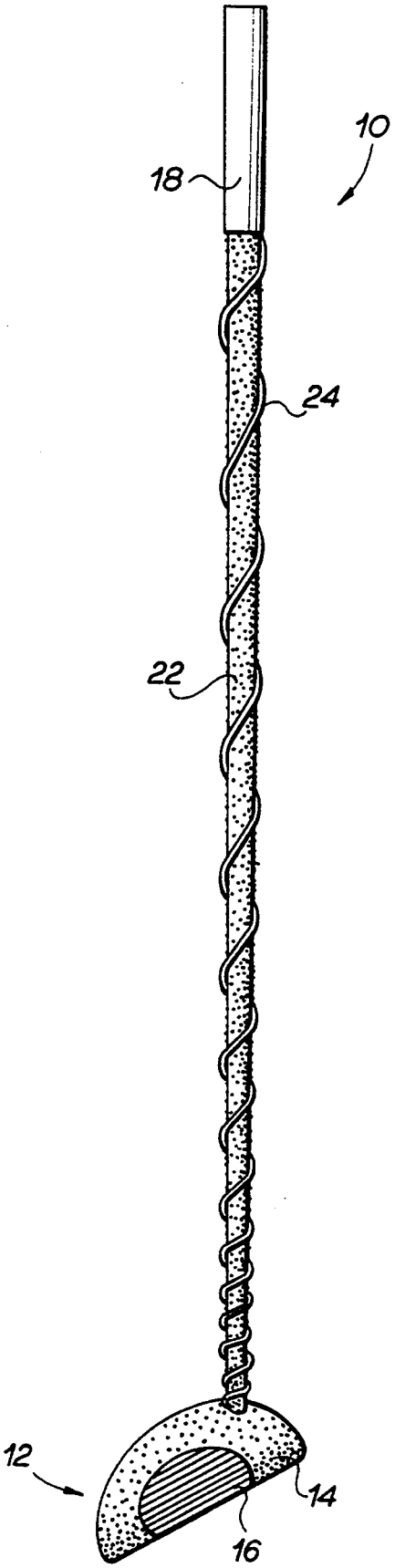
FIG. 1 is a front elevational view of a first embodiment of a golf club and method in accordance with the present invention.

Referring now to the drawings wherein like reference numerals designate corresponding parts throughout the several views, a first embodiment of a golf club in accordance with the present invention is illustrated in FIGS. 1 through 6. As shown in FIG. 1, a golf club 10 comprises a head 12 having a face 14 with a striking plate 16 for contacting a golf ball, a handle 18 for swinging the golf club 10, and a generally cylindrical tapered shaft 22 for connecting the head 12 to the handle 18.

Figure 2:
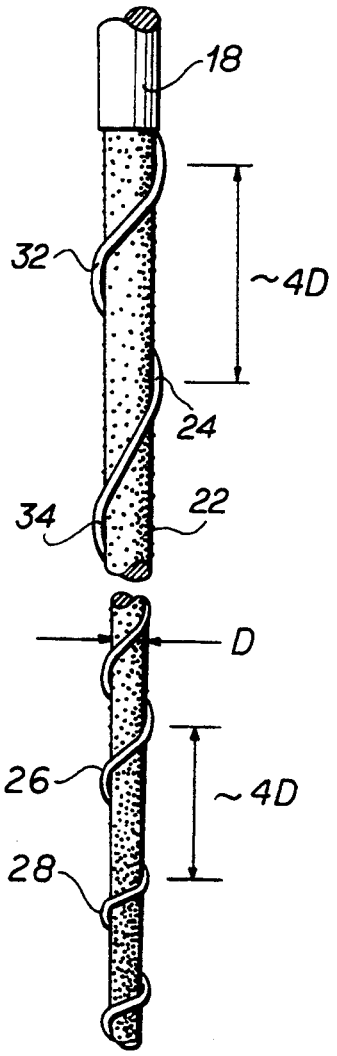
FIG. 2 is a partial exploded front elevational view of the golf club shaft of FIG. 1.

In accordance with a significant aspect of the present invention, the golf club 10 has a spiraling rib 24 protruding slightly outwardly from the generally tapering cylindrical outer surface of the shaft 22, running around the circumference of the shaft 22, and running longitudinally along the shaft 22 in a spiral configuration, as shown in FIGS. 1 and 2. The spiraling rib 24 optimally minimizes air vortices and drag generated behind the shaft 22 when the shaft 22 is in motion during a golf club swing. In essence, the minimization of vortices decreases the effective air resistance experienced by the golf club 10 while in motion.

The spiraling rib 24 may be formed by any conventional technique, for example, but not limited to, a molding process, lamination process, or some other suitable fabrication process. Another workable example of a process for fabricating the spiraling rib 24 is to dispose a cord, for instance, a metal wire, elongated plastic element, nylon fiber, or other elongated element made from some other suitable material, about the shaft 22 in a continuous spiral configuration. Further, the cord may be affixed to the shaft 22 via a bonding agent, such as glue, and/or may be wrapped tightly for binding securement.

Although not required, the spiral configuration of rib 24 should have a pitch which increases from the head 12 to the handle 18, as shown in Figs.. 1 and 2, in order to achieve optimal minimization of air vortices and drag. More specifically, it is preferred that the length of one complete wrap of the rib 24 around the shaft 22 at a particular region be approximately equal to four times the average diameter (D) ($\pm 10\%$) of the shaft 22 at that particular region, as is indicated in FIG. 2. In a specific workable embodiment of the present invention, the spiraling rib 22 protrudes from the shaft 22 approximately 1/16 of an inch, and the pitch of the spiraling rib 24 increases from approximately one inch from adjacent rib sections 26, 28 near the head 12, as indicated in FIG. 2, to approximately six inches between adjacent rib sections 32, 34 near the handle 18, as further indicated in FIG. 2.

The shaft 22 with rib 22 may be formed from any suitable construction material, including, for example, metal, graphite, plastic, wood, or any combination thereof with a finish of perhaps paint, plastic, synthetic or natural varnish, or any other suitable coating material. However, the shaft 22 should have a substantially cylindrical outer surface with the rib 22 protruding therefrom so that the rib 22 channels and directs air towards the head 12.

In order to further enhance swinging motion by minimizing air resistance, the shaft 22 may be provided with a rough outer coating of granulized particles, preferably similar to the size of sand granules, as illustrated in FIGS. 1 and 2. The particles may be affixed to the shaft 22 via any conventional means, for example, by using a bonding agent such as glue. The rough texture of the shaft 22 creates a turbulent boundary and reduces air separation.

Furthermore, a coating, such as plastic or other suitable material, may be disposed over the spiraling rib 24 and the shaft 22 so as to form a unitary shaft element with the spiraling rib 24 as an integral part of the shaft 22. This feature provides for better durability and operation.

Figure 3:
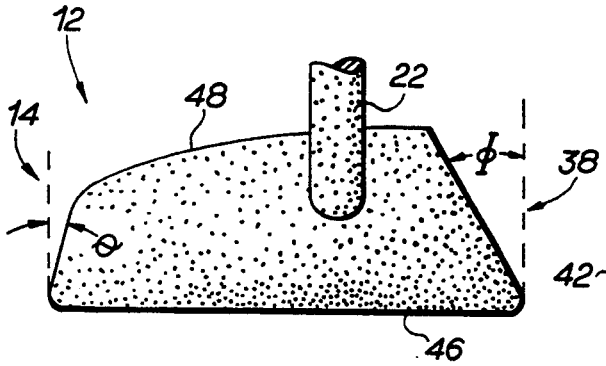
FIG. 3 is a right side elevational view of the golf club head of FIG. 1.
Figure 4:
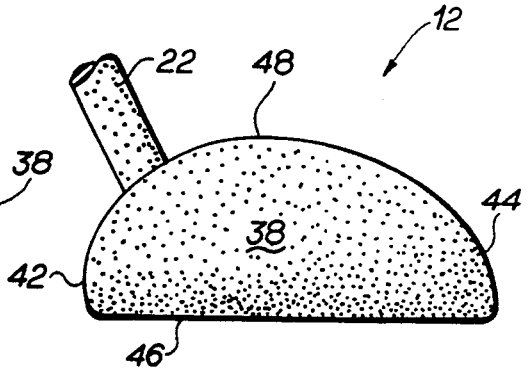
FIG. 4 is a rear elevational view of the golf club head of FIG. 1.
Figure 5:
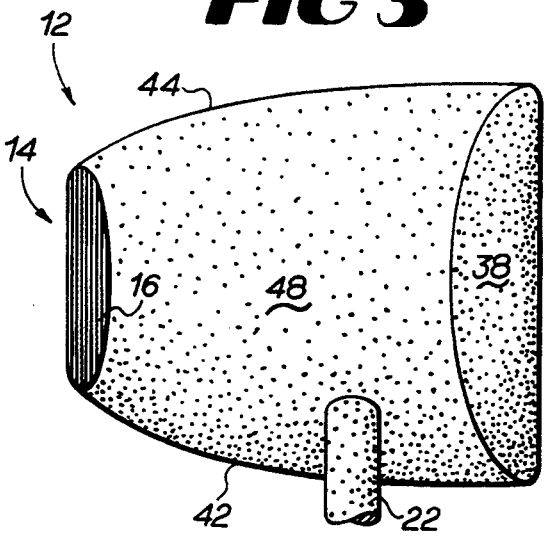
FIG. 5 is a top plan view of the golf club head of FIG. 1.
Figure 6:
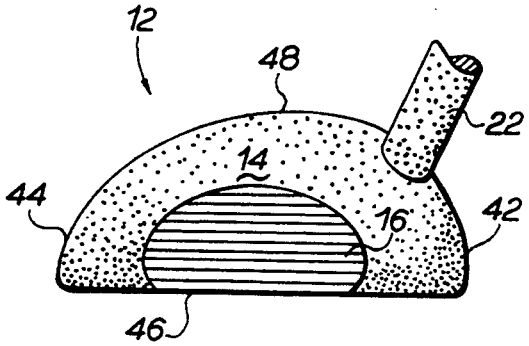
FIG. 6 is a front elevational view of the golf club head of FIG. 1.

The preferred construction for the head 12 of the golf club 10 is illustrated in FIGS. 3–6. As shown in FIG. 3, the head 12 has a body with a front face 14 angled inwardly by an angle theta Θ, preferably about 10°–20°. Further, a rear end 38 of the head 12 angles inwardly at an angle phi Θ, preferably about 40°. The rear end 38 has a circular top contour as shown in FIG. 4. As illustrated in FIG. 5, the right and left sides 42, 44, respectively, decrease parabolically in curvature from the rear end 38 to the front face 14. The bottom 46 of the head 12 is substantially flat, as illustrated in FIGS. 3, 4 and 6. Finally, a top 48 of the head 12 is circular as viewed from the front face 14 and is parabolic as viewed from the right hand left sides 42, 44. Because of the foregoing configuration, the air drag caused by the motion of the head 12 through the air is optimally minimized. The unique shape is such that the vortices which normally shed from the head are eliminated.

The head 12 may be formed from any suitable construction material, including, for example, metal, plastic, wood, or any combination thereof. Moreover, the finish of the head 12 may be paint, plastic, synthetic or natural varnish, or any other suitable coating material.

The head 12 may also be provided with a rough outer texture, as shown in FIGS. 3 through 6. Preferably, the rough outer texture is effectuated by affixing granulized particles to the outer surface of the head 12. The granulized particles may be affixed to the head 12 via any conventional bonding agent, such as glue.

Figure 7B:
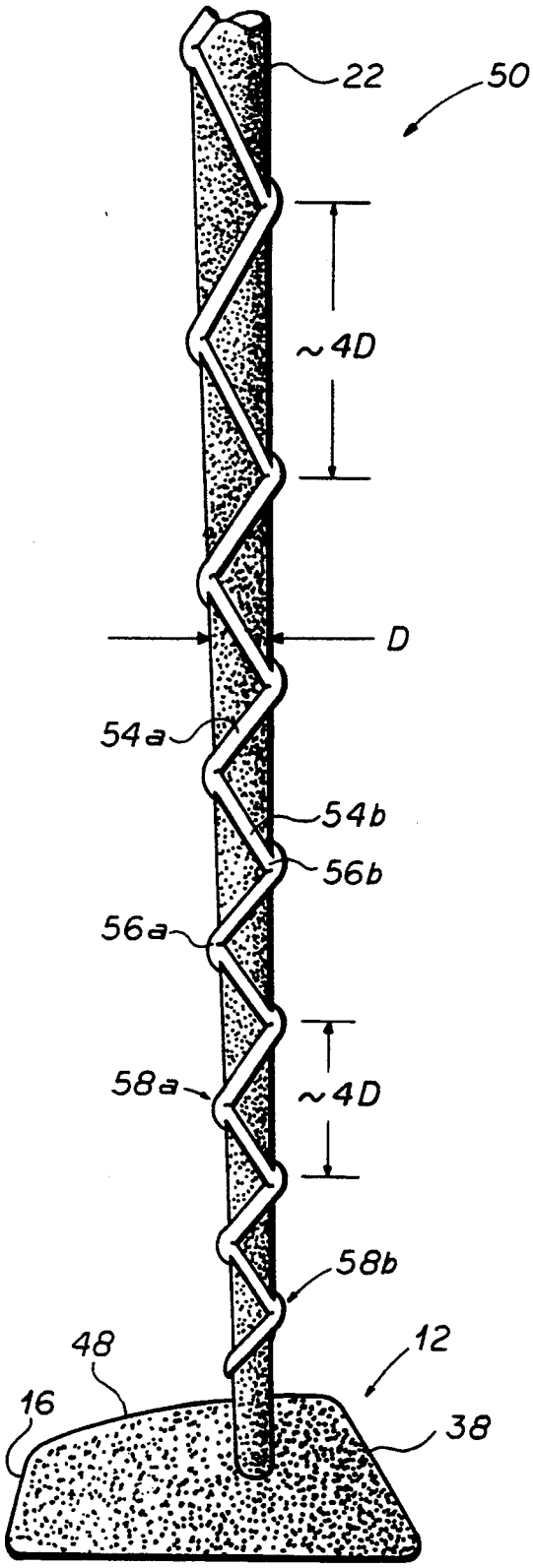
FIG. 7B is a partial rear elevational view of the golf club of FIG. 7A.
Figure 7A:
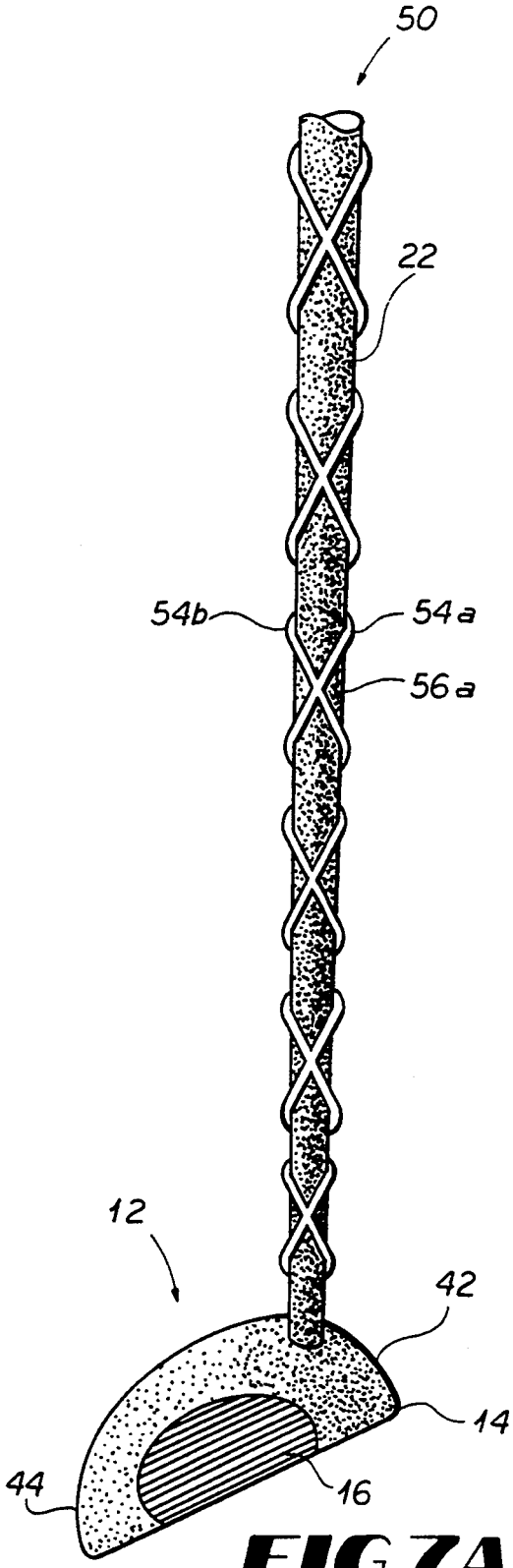
FIG. 7A is a partial front elevational view of a second embodiment of a golf club and method in accordance with the present invention.

A second embodiment for a golf club 50 in accordance with the present invention is shown in FIGS. 7A and 7B. Although the spiral configuration of the first embodiment is very effective by itself in breaking up air vortices generated behind the golf club shaft 22 during club motion, an improvement to the flow conditions of the first embodiment can be accomplished by using a double spiral configuration, which is employed in the second embodiment as illustrated in FIGS. 7A and 7B. As shown in FIGS. 7A and 7B, the golf club 50 of the second embodiment has a first spiral rib **54*a* configured about the shaft 22 with a clockwise wrap from a vantage point looking up the shaft 22 and a second spiral rib 54b configured about the shaft 22 with a counterclockwise wrap from the same vantage point. As a result of the two opposite spiralling configurations, a series of intersection points 56 are formed and reside longitudinally along the shaft 22. These intersection points 56*a*, where the first and second spiral ribs 54*a*, 54*b* intersect, are arranged so that the intersection points 56*a* lie linearly along the front face of the golf club 50 which faces the direction of club motion i.e., so that the intersection points 56*a* strike the air head on. In a sense, this series of intersection points 56*a* produce a series of outwardly-protruding, X-like (or cross-like) rib elements 58*a* disposed linearly and longitudinally along the front face of the shaft 22. Each X-like rib element 58*a* has four arms extending outwardly from a centralized point 56*a***.

With the intersection points **56*a*** arranged as previously described, a correlative set of intersection points 56*b* reside along a line on the opposing side of the shaft 22, i.e., on the trailing surface of the shaft 22 during club motion. The series of intersection points 56B generate a series of outwardly-protruding, X-like rib elements 58*b* disposed linearly and longitudinally along the trailing surface of the shaft 22. Each X-like rib element 58*b* has four arms extending outwardly from a centralized point 56*b*.

The pitch of the first and second spiral ribs 54*a*, 54*b* is essentially the same as the pitch of the rib 26 in the first embodiment, and hence, that discussion is incorporated here by reference. For emphasis, it is preferred that the length of one complete wrap of each rib 54*a*, 54*b* around the shaft 22 at a particular region be approximately equal to four times the average diameter (D) (±10%) of the shaft 22 at that particular region, as is indicated in FIG. 7B. Further in the preferred embodiment, the spiral ribs 54*a*, 54*b* are both smooth and protrude about 1/16 inches from the surface of the shaft 22. The spiral ribs 54*a*, 54*b* may be disposed on the shaft 22 in any suitable manner. For instance, the spiral ribs 54*a*, 54*b* may be molded, wrapped, or impressed onto the shaft 22. Moreover, preferably, the club head 12 shown and described relative to FIGS. 3 through 5 is employed in the club 50 of the second embodiment in FIGS. 7A and 7B. However, needless to say, many other club configurations are suitable.

With the forgoing construction, the spiral ribs 54*a*, 54*b* very effectively break up air vortices behind the shaft 22 during motion of the golf club 50. In fact, the spirals 54*a*, 54*b* establish a flow pattern around the shaft 22 similar to that around a delta wing, which is well known in the art, thus reducing wind noise and air drag.

It will be obvious to those skilled in the art that many variations and modifications may be made to the above-described preferred embodiment without substantially departing from the spirit and scope of the present invention. Accordingly, all such variations and modifications are intended to be included herein within the scope of the present invention and the following claims.

Wherefore, the following is claimed:

1. A golf club improvement for a golf club having a head for striking a golf ball and a shaft connected to said head at a first end and having a handle at a second end, the improvement for substantially reducing air resistance to said golf club while in motion, comprising a series of rib elements having a center point and at least three arms extending therefrom, said rib elements protruding outwardly from an exterior surface of said shaft a distance sufficient to reduce said air resistance and disposed longitudinally along said shaft.

2. The golf club improvement of claim 1, wherein said rib elements are in an X-shaped configuration with four of said arms.

3. The golf club improvement of claim 1, wherein said distance that said rib elements protrude from said shaft is approximately one sixteenth (1/16) of an inch.

4. The golf club improvement of claim 1, further comprising particles affixed about the perimeter of said shaft.

5. The golf club improvement of claim 1, wherein said head comprises a body having a face angling inwardly, a rear end having a surface angling inwardly from an elongate rear bottom edge, said face having a front bottom edge which is substantially parallel to said rear bottom edge of said rear end, right and left sides decreasing in curvature from said rear end to said face, a substantially flat bottom, and a top which is semicircular as viewed from said face and is parabolic as viewed from said sides.

6. The golf club improvement of claim 2, wherein said rib elements are formed by two spiral ribs running along said shaft, each of said ribs having a pitch which increases from said head to said handle.

7. The golf club improvement of claim 6, wherein said pitch decreases from approximately one inch between adjacent rib sections at said head to approximately six inches between adjacent rib sections at said handle.

8. A golf club for minimizing wind drag, comprising:
a head for striking a golf ball;
a shaft connected to said head at a first end and having a handle at a second end; and
a plurality of rib elements protruding from an exterior surface of said shaft, each of said rib elements having at least three arms which are joined, said rib elements protruding outwardly from said shaft a distance sufficient to minimize said wind drag and arranged linearly along said exterior surface of said shaft which strikes air during a club swing.

9. The golf club of claim 8, wherein said rib elements are in an X-shaped configuration with four of said arms.

10. The golf club of claim 8, wherein said distance that said rib elements protrude from said shaft is approximately one sixteenth (1/16) of an inch.

11. The golf club of claim 8, further comprising particles affixed about the perimeter of said shaft.

12. The golf club of claim 8, wherein said head comprises a body having a face angling inwardly, a rear end having a surface angling inwardly from an elongate rear bottom edge, said face having a front bottom edge which is substantially parallel to said rear bottom edge of said rear end, right and left sides decreasing in curvature from said rear end to said face, a substantially flat bottom, and a top which is semicircular as viewed from said face and is parabolic as viewed from said sides.

13. The golf club of claim 9, wherein said rib elements are formed by two spiral ribs running longitudinally along said shaft, each of said ribs having a pitch which increases from said head to said handle.

14. The golf club improvement of claim 13, wherein said pitch decreases from approximately one inch between adjacent rib sections at said head to approximately six inches between adjacent rib sections at said handle.

15. A method for decreasing air resistance to the motion of a golf club, comprising the steps of:
forming a head for striking a golf ball;
forming a shaft connected to said head at a first end and having a handle at a second end; and
forming a plurality of rib elements protruding outwardly from an exterior surface of said shaft a distance sufficient to reduce said air resistance and running longitudinally along said shaft for decreasing wind drag of said golf club, said rib elements having a center with at least three arms extending outwardly therefrom.

16. The method as set forth in claim 15, wherein said plurality of rib elements are formed in an X-shaped configuration with said at least three arms comprising four arms.

17. The method as set forth in claim 15, wherein said step of forming said plurality of rib elements comprises the step of running two spiral ribs along said shaft with each of said ribs having a pitch which increases from said head to said handle.

18. The method as set forth in claim 15, further comprising the step of affixing particles about the perimeter of said shaft.

* * * * *